US008790853B2

(12) United States Patent
Wu et al.

(10) Patent No.: US 8,790,853 B2
(45) Date of Patent: Jul. 29, 2014

(54) CHARGE GENERATING COMPOSITION

(75) Inventors: Jin Wu, Webster, NY (US); John J. Wilbert, Macedon, NY (US); Marc J. Livecchi, Rochester, NY (US); Liang-bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1233 days.

(21) Appl. No.: 11/364,228

(22) Filed: Mar. 1, 2006

(65) Prior Publication Data

US 2007/0207396 A1 Sep. 6, 2007

(51) Int. Cl.
*G03G 5/00* (2006.01)

(52) U.S. Cl.
USPC ..... 430/59.1; 430/96; 430/135

(58) Field of Classification Search
USPC ..... 430/59.1, 96, 135
See application file for complete search history.

(56) References Cited

U.S. PATENT DOCUMENTS

| | | | | | |
|---|---|---|---|---|---|
| 3,885,961 | A * | 5/1975 | Kimura et al. | ..... | 430/96 |
| 3,904,499 | A * | 9/1975 | Morgan | ..... | 522/95 |
| 3,953,207 | A | 4/1976 | Horgan | | |
| 4,593,051 | A * | 6/1986 | Koleske | ..... | 522/2 |
| 4,599,401 | A * | 7/1986 | Koleske | ..... | 528/408 |
| 4,629,779 | A * | 12/1986 | Koleske | ..... | 528/408 |
| 4,707,535 | A * | 11/1987 | Koleske | ..... | 528/110 |
| 4,725,653 | A * | 2/1988 | Koleske | ..... | 525/510 |
| 4,786,705 | A * | 11/1988 | Koleske | ..... | 528/72 |
| 4,812,488 | A * | 3/1989 | Koleske et al. | ..... | 522/31 |
| 4,818,776 | A * | 4/1989 | Koleske | ..... | 522/31 |
| 4,874,798 | A * | 10/1989 | Koleske et al. | ..... | 522/31 |
| 5,495,049 | A | 2/1996 | Nukada et al. | | |
| 5,552,253 | A | 9/1996 | Kovacs | | |
| 5,725,985 | A | 3/1998 | Nealey et al. | | |
| 5,955,230 | A * | 9/1999 | Kimura et al. | ..... | 430/67 |
| 6,017,666 | A | 1/2000 | Nealey et al. | | |
| 6,197,464 | B1 | 3/2001 | Dinh et al. | | |
| 6,207,334 | B1 | 3/2001 | Dinh et al. | | |
| 6,395,440 | B1 * | 5/2002 | Yamaguchi et al. | ..... | 430/58.7 |
| 6,911,288 | B2 | 6/2005 | Goodbrand et al. | | |
| 6,967,069 | B2 | 11/2005 | Wu et al. | | |
| 6,991,880 | B2 | 1/2006 | Tong et al. | | |
| 2003/0175603 | A1 * | 9/2003 | Nakata et al. | ..... | 430/58.1 |
| 2004/0190949 | A1 * | 9/2004 | Yamaguchi et al. | ..... | 399/286 |
| 2004/0265720 | A1 * | 12/2004 | Kadota | ..... | 430/108.6 |
| 2005/0019684 | A1 * | 1/2005 | Sekiya et al. | ..... | 430/66 |
| 2005/0089789 | A1 * | 4/2005 | Zhu | ..... | 430/126 |
| 2005/0227182 | A1 * | 10/2005 | Ali et al. | ..... | 430/311 |
| 2007/0196751 | A1 * | 8/2007 | Wu et al. | ..... | 430/59.1 |

OTHER PUBLICATIONS

Inami, K. et. al., Crystal Structure of Hydroxy Gallium Phthalocyanine (HOGaPc) and Chloro Gallium Phthalocyanine (ClGaPc) Using Rietveld Analysis, Fuji Xerox, www.fujizerox.co.jp, printed from website on Feb. 11, 2006, 1 page.

Application Data, SAA-100/SAA-101/SAA-103 Hydroxy Functional Resins for Toners, www.lyondell.com, 2004, 3 pages.

(Continued)

*Primary Examiner* — Mark A Chapman

(74) *Attorney, Agent, or Firm* — MH2 Technology Law Group LLP

(57) ABSTRACT

The present disclosure is directed to charge generating compositions and methods of making the charge generating compositions. The composition may comprise one or more polymers comprising styrene units and allyl alcohol units, and one or more photoconductive particles. Electrophotographic devices employing the compositions, including methods of making the devices, are also disclosed.

20 Claims, 1 Drawing Sheet

(56) References Cited

OTHER PUBLICATIONS

SAA Resinous Polyols, Performance Enhancers for Coatings and Inks. Lyondell Chemical Company, 2004, pp. 1-7.

SAA-100 and 103, Low-Viscosity Resins for Weatherable and Corrosion-Resistant Air-Dry Coatings Using SAA-100 and 103, Lyondell Chemical Company, 2006, pp. 1-4.

* cited by examiner

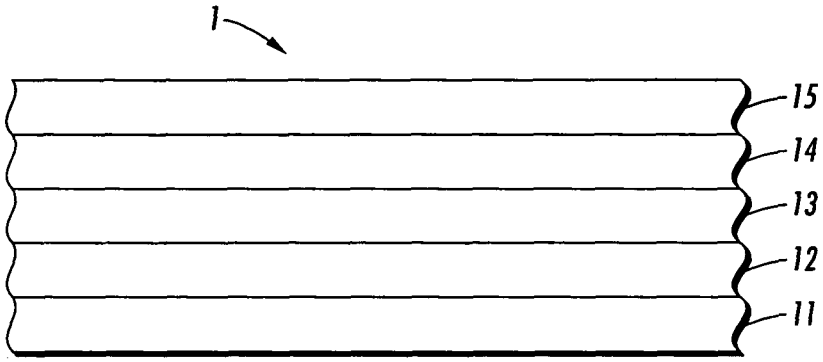
1
15
14
13
12
11

CHARGE GENERATING COMPOSITION

DESCRIPTION OF THE DISCLOSURE

1. Field of the Disclosure

The present disclosure is directed to charge generating compositions, and more particularly, to charge generating compositions that can be used, for example, in electrophotographic imaging.

2. Background of the Disclosure

In electrophotographic imaging, also known as xerography, an electrophotographic imaging member is electrostatically charged. The electrophotographic imaging member is then exposed to a light pattern of an input image to selectively discharge the surface of the electrophotographic imaging member. The resulting pattern of charged and discharged areas on the electrophotographic imaging member forms an electrostatic charge pattern, referred to as a latent image, which conforms to the input image.

The latent image is developed by contacting it with finely divided electrostatically attractable powder called toner. Toner is held on the charged image areas by electrostatic force. The toner image may then be transferred to a substrate or support member, and then affixed by a fusing process to form a permanent image on the substrate or support member. After transfer, excess toner left on the electrophotographic imaging member is cleaned from its surface, and residual charge is erased from the electrophotographic imaging member.

Electrophotographic imaging members generally comprise one or more active layers, including a charge generating layer. The charge generating layer can comprise one or more photoconductive particles dispersed in one or more polymeric binders. Conventional binders used in electrophotographic imaging members often contain vinyl chloride. Examples of such conventional binders are disclosed in U.S. Pat. No. 5,725,985, incorporated herein by reference in its entirety, and U.S. Pat. No. 6,017,666, incorporated herein by reference in its entirety. However, the use of halogens, such as vinyl chloride, may be problematic for environmental reasons.

Binders that may be safer for the environment have been developed. One such binder comprises a copolymer of styrene and 4-vinyl pyridine. This binder has been used in charge generating layers (CGL) to disperse hydroxy gallium phthalocyanine (HOGaPc) pigment. It is known that this binder has resulted in problems, such as, for example, poor dispersion quality of the pigment and/or poor cyclic stability.

Another non-halogenated binder is disclosed in copending U.S. application Ser. No. 10/986,847, by Jin Wu et al., entitled NON-HALOGENATED POLYMERIC BINDER, which was filed on Nov. 15, 2004. The description of this non-halogenated binder is herein incorporated by reference in its entirety. The binder comprises copolymers of vinyl acetate and crotonic acid.

SUMMARY OF THE DISCLOSURE

In one aspect, the present disclosure is directed to a charge generating composition. The composition may comprise one or more polymers comprising styrene units and allyl alcohol units, and one or more photoconductive particles.

Another aspect of the present disclosure is directed to an electrophotographic imaging member. The electrophotographic imaging member comprises a substrate; at least one charge generating layer comprising one or more photoconductive particles and one or more polymers comprising styrene units and allyl alcohol units; and at least one charge transport layer. The charge generating layer and charge transport layer can be positioned over the substrate in a configuration which allows formation of an electrostatic charge pattern on the electrophotographic imaging member.

Another aspect of the present disclosure is directed to a method for making a charge generating composition. The method comprises mixing one or more photoconductive particles, one or more polymers and a solvent to form a dispersion. The one or more polymers can comprise styrene units and allyl alcohol units. The dispersion can be applied to a substrate, and then dried to form a charge generating composition.

Another aspect of the present disclosure is directed to a method of forming an electrophotographic imaging member. The method comprises providing a substrate; forming at least one charge generating layer comprising one or more photoconductive particles and one or more polymers comprising styrene units and allyl alcohol units over the substrate; and forming at least one charge transport layer over the substrate. The charge generating layer and charge transport layer can be formed over the substrate in a configuration which allows formation of an electrostatic charge pattern on the electrophotographic imaging member.

It is to be understood that both the foregoing general description and the following detailed description are exemplary and explanatory only and are not restrictive of the disclosure, as claimed.

The accompanying drawings, which are incorporated in and constitute a part of this specification, illustrate several aspects of the disclosure and, together with the description, serve to explain the principles of the disclosure.

BRIEF DESCRIPTION OF THE DRAWINGS

FIG. 1 illustrates an electrophotographic imaging member, according to one aspect of the present disclosure.

DETAILED DESCRIPTION

Reference will now be made in detail to various exemplary aspects of the present disclosure, examples of which are illustrated in the accompanying drawing. Wherever possible, the same reference numbers will be used throughout the drawings to refer to the same or like parts.

The present invention is directed to novel charge generating compositions, and polymeric binders which may be employed in the compositions. In certain aspects, the polymeric binder material can be completely free of halogen species. In other aspects, the polymeric binder can be effectively free of halogen species such that any halogen species that are present do not substantially alter the properties of the non-halogenated polymeric binder material. In certain applications, complete and/or effective absence of halogen species from the non-halogenated polymeric binder material may be desirable because of the known environmental effects that are caused by such halogenated materials.

In other aspects, halogen species may be present in amounts sufficiently low to meet EPA or other federal or state law requirements, or which provide an acceptable risk of harm to the environment. For example, the polymeric binder may comprise less than 1% by weight halogen. By obviating or reducing the amount of halogenated species used in producing the non-halogenated polymeric binder material, more environmentally friendly results may be provided in the production, handling, use, and/or disposal of the final products incorporating the binder.

The polymeric binders of the present disclosure are formed from monomers chosen of styrene and allyl alcohol. In one aspect of the present disclosure, the polymeric binder may be a copolymer formed from styrene and allyl alcohol. In other aspects, other suitable monomer species may be used in addition to styrene and allyl alcohol to form the polymeric binder material. Thus, for example, suitable polymeric binder materials may comprise one or more polymers formed from at least one additional monomer chosen from ethylene, propylene, isobutylene, 4-hydroxyl styrene, vinyl acetate, vinyl alcohol, vinyl butyral, acrylic, vinyl ether, vinyl pyridine, hydroxyalkyl acrylate, acrylic nitrile, acrylic acid, methacrylic acid, crotonic acid, maleic acid, vinyl benzoic acid, vinyl phosphonic acid and the like.

The monomers may react to form a polymer comprising polymeric units arranged in any suitable distribution along the polymer chain. For example, the polymer may be a block polymer, random polymer, alternating polymer, or graft polymer. The terms "polymeric units" or "units" as used herein are defined as the repeating portions of the polymer chain formed from the monomers. Thus, a "styrene unit" is a unit of the polymer chain contributed by a styrene monomer.

The polymers of the present disclosure may comprise polymeric units in any desired amount suitable for forming the resultant polymeric binder. In exemplary, aspects, the polymeric binder may comprise a copolymer of about 50 mole % to about 95 mole % styrene units and about 5 mole % to about 50 mole % allyl alcohol units. For example, the polymeric binder may comprise a copolymer of about 60 mole % to about 80 mole % styrene units and from about 20 mole % to about 40 mole % allyl alcohol units. In yet another example, the polymeric binder may comprise a copolymer of about 70 mole % styrene units and about 30 mole % allyl alcohol units.

In one aspect of the disclosure, the polymeric binders can comprise non-halogenated copolymers having the following structural formula:

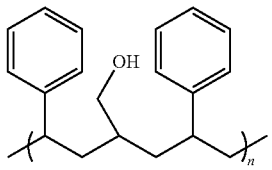

where n is an integer from about 5 to about 5,000, or from about 10 to about 500, or from about 20 to about 50, and represents the number of repeating segments of the polymer. Examples of such copolymers include SAA-100™, SAA-101™ and SAA-103™, all of which are available from Lyondell; and RJ-100™, and RJ-101™, all of which are available from Monsanto.

The polymers of the present disclosure may have any suitable weight average molecular weight. For example, the polymers can have a weight average molecular weight ranging from about 1,000 to about 300,000, such as from about 2,000 to about 10,000.

The polymeric binders of the present disclosure may be used to make charge generating compositions, which may be in the form of, for example, charge generating layers used in electrophotographic imaging members, as will be described in greater detail below. In aspects of the present disclosure, the charge generating compositions may comprise the binders described above, and one or more photoconductive materials.

The charge generating compositions may comprise any suitable organic or inorganic photoconductive materials. In certain aspects of the disclosure, suitable organic photoconductive materials include various organic pigments and organic dyes. Examples of suitable organic pigments and organic dyes include azo pigment, a quinoline pigment, a perylene pigment, an indigo pigment, a thioindigo pigment, a bisbenzimidazole pigment, a phthalocyanine pigment, such as hydroxyl gallium phthalocyanine Type V (HOGaPc V) and titanyl phthalocyanine Type IV (TiOPc IV), a quinacridone pigment, a quinoline pigment, a lake pigment, an azo lake pigment, an anthraquinone pigment, an oxazine pigment, a dioxazine pigment, a triphenylmethane pigment, an azulenium dye, a squalium dye, a pyrylium dye, a triallylmethane dye, a xanthene dye, a thiazine dye and cyanine dye. Examples of suitable inorganic photoconductive materials include amorphous silicon, amorphous selenium, tellurium, a selenium-tellurium alloy, cadmium sulfide, antimony sulfide, zinc oxide and zinc sulfide. In some aspects of the disclosure, combinations of two or more of the above listed organic or inorganic photoconductive materials may be employed. The photoconductive materials may be in any suitable form, including particles, such as microparticles and nanoparticles.

In aspects of the disclosure, the charge generating composition may comprise additional ingredients, such as, antioxidants, plasticizers, surface modifiers, photodegradation resistant agents and inactivating agents. Examples of these additional ingredients include phenolic compounds; sulfur compounds; amine compounds; bis(dithiobenzyl)nickel; nickel di-n-butylthiocarbamate; phthalates such as diisooctyl phthalate, diisodecyl phthalate, butyl benzyl phthalate, butyl 2-ethylhexyl phthalate, and 2-ethylhexyl isodecyl phthalate; citrates such as acetyl tributyl citrate, acetyl triethyl citrate, and tributyl citrate; phosphates such as tri(2-ethylhexyl) phosphate, triphenyl phosphate, and tributyl phosphate; epoxies such as epoxidized soybean oil, 2-ethylhexyl epoxy tallate, and epoxidized linseed oil; adipic acid polyester, azelaic acid polyester, sebacic acid polyester, blown castor oil, blown soybean oil, blown linseed oil, dibutyl sebacate, di(2-ethylhexyl) sebacate, di(2-ethylhexyl) azelate, tin mercaptide, cycloaliphatic epoxy, diglycidyl ether of bisphenol A, and light stabilizers such as substituted benzophenones and hindered amines.

In some aspects of the disclosure, the charge generating composition may be made by mixing the desired ingredients, including, for example, one or more of the above described polymers, one or more photoconductive particles and any desired additional ingredients in a solvent to form a dispersion. Any suitable technique may be utilized to form the dispersion. In one aspect of the disclosure, the photoconductive materials, with or without binder, may be milled in the absence of a solvent prior to forming the dispersion. In other aspects, a concentrated mixture of photoconductive particles and binder in solvent may be initially milled and thereafter diluted with additional solvent and binder in preparation for forming a charge generating layer.

The dispersion may comprise any suitable solvent. Examples of suitable solvents include organic solvents such as methanol, ethanol, n-propanol, n-butanol, benzyl alcohol, methyl cellosolve, ethyl cellosolve, acetone, methyl ethyl ketone, methyl propyl ketone, methyl isobutyl ketone, diisobutyl ketone, methyl isoamyl ketone, methyl n-amyl ketone, cyclohexanone, chlorobenzene, methyl acetate, ethyl acetate, isopropyl acetate, propyl acetate, methyl PROPASOL™ acetate, n-butyl acetate, isobutyl acetate, amyl acetate, diacetone alcohol, dioxane, tetrahydrofuran (THF), toluene, xylene, isophorone, methylene chloride and chloroform, and the like, and mixtures of two or more thereof.

The solid content of the dispersion used to form the charge generating layer, as described in greater detail below, may be any suitable amount, and may depend in part on the coating technique used to form the charge generating layer. For example, the solid content of the dispersion may range from about 2 percent by weight to about 20 percent by weight based on the total weight of the dispersion. The expression "solid" refers to the photoconductive particles and/or solid binder components of the dispersion.

Examples of suitable milling techniques for forming the above described dispersions include ball milling, roll milling, milling in vertical or horizontal agitators, sand milling, and the like. The solid content of the mixture being milled can be selected from a wide range of concentrations.

The quality of the dispersion used to form the charge generating composition may be determined by calculating a reflective scattering index (RSI) value for the dispersion. The RSI value is a measure via UV-Vis spectrometer of the dispersion, and is calculated by graphing the absorbance value of the dispersion at various wavelengths. Specifically, the RSI is calculated by dividing the absorbance of the dispersion at a wavelength of 1000 nm by the absorbance value of the dispersion at its highest absorbance peak along the graph, and multiplying the dividend by 100.

In some aspects, the dispersions of the present disclosure may have RSI values of less than about 30, such as less than about 20, or in other aspects, less than about 15. Generally speaking, smaller RSI values can result in more stable dispersions and better print quality. For example, in certain aspects it has been found that RSI, values of less than about 30, such as less than about 15, may result in improved stability of the dispersion and improved print quality for devices made using the dispersion. It has also been found that RSI values of about 30 and above can result in an unstable dispersion and poor print quality for devices made with the dispersion.

FIG. 1 is a cross sectional view schematically showing one example of an electrophotographic imaging member according to the present disclosure. Electrophotographic imaging member 1 comprises a substrate 11, undercoat layer 12, charge generating layer 13, charge transport layer 14 and overcoat layer 15.

In aspects of the disclosure, substrate 11 may comprise, for example, a conductive plate, a conductive drum or a conductive belt comprising, for example, a metal such as aluminum, copper, zinc, stainless steel, chromium, nickel, molybdenum, vanadium, indium, gold or platinum, or an alloy thereof. In aspects, substrate 11 may comprise a flexible support layer, such as paper or a plastic film or belt. The flexible support layer may be coated with a conductive material, such as conductive polymers; indium oxide; or metals, such as aluminum, palladium, gold, or alloys thereof. In some aspects, one or more surfaces of substrate 11 may be treated by, for example, anodic oxidation coating, hot water oxidation, coloring, or diffused reflection treatments such as graining.

In FIG. 1, an undercoat layer 12 is formed over substrate 11. Undercoat layer 12 can provide improved adhesion to subsequently formed layers to substrate 11, as is well known in the art. Undercoat layer 12 may comprise one or more binder resins and/or compounds. Examples of undercoat resins and compounds include polyamide resins, vinyl chloride resins, vinyl acetate resins, phenolic resins, polyurethane resins, melamine resins, benzoguanamine resins, polyimide resins, polyethylene resins, polypropylene resins, polycarbonate resins, acrylic resins, methacrylic resins, vinylidene chloride resins, polyvinyl acetal resins, vinyl chloride-vinyl acetate copolymers, polyvinyl alcohol resins, water-soluble polyester resins, nitrocellulose, casein, gelatin, polyglutamic acid, starch, starch acetate, amino starch, polyacrylic acids, polyacrylamides, zirconium chelate compounds, titanyl chelate compounds, titanyl alkoxide compounds, organic titanyl compounds and silane coupling agents. The undercoat resins and compounds can be used either alone or in a combination of two or more resins and/or compounds.

In some aspects of the disclosure, undercoat layer 12 may also comprise fine particles of titanium oxide, zinc oxide, tin oxide, antimony-doped tin oxide, aluminum oxide, silicon oxide, zirconium oxide, barium titanate, or the like, which may be added to the above-mentioned binder resin to enhance various properties, such as optical and/or electrical properties of the undercoat layer. Undercoat layer 12 may further comprise one or more suitable solvents for mixing and or providing a composition suitable for forming undercoat layer 12 over substrate 11.

In one embodiment, undercoat layer 12 may comprise zirconium acetylacetonate tributoxide, γ-aminopropyltriethoxysilane and poly(vinyl butyral) BM-S. These ingredients may be dissolved in any suitable solvent, such as, for example, n-butanol.

Undercoat layer 12 may be formed by any suitable method. Suitable methods well known in the art for forming undercoat layers include, for example, blade coating, Mayer bar coating, spray coating, dip coating, bead coating, air-knife coating or curtain coating. In one exemplary embodiment, undercoat layer 12 may be applied via a ring coater.

The thickness of undercoat layer 12 may be any desired thickness. In some aspects of the disclosure, the thickness of undercoat layer 12 may range from about 0.01 μm to about 30 μm.

In some aspects, a hole blocking layer (not illustrated) may be formed. Any suitable blocking layer capable of forming an electronic barrier to holes between the adjacent photoconductive layer and the underlying conductive layer may be utilized, including hole blocking layers well known in the art. In some aspects of the disclosure, the blocking layer may include an oxidized surface that inherently forms on the outer surface of most metal ground plane surfaces when exposed to air. The blocking layer may be applied as a coating by any suitable technique, including techniques well known in the art. In some aspects, the blocking layer is continuous and has a thickness of less than about 2 micrometers, or from about 1 to about 2 micrometers, because greater thicknesses may lead to undesirably high residual voltage. In one aspect, the blocking layer is composed of three components: zirconium tributoxides, gamma amino propyltriethoxy silane, and polyvinyl butyral. The proportions of these three components can be, for example: 2 parts of the zirconium tributoxides to 1 part gamma amino propyltriethoxy silane by mole ratio; and 90 parts by weight of the above mixture of the zirconium tributoxides and gamma amino propyltriethoxy silane to 10 parts by weight of the polyvinyl butyral.

Referring again to FIG. 1, a charge generating layer 13 may be formed over undercoat layer 12 by any suitable method. For example, charge generating layer 13 may be formed by applying the charge generating compositions of the present disclosure, as described above, to undercoat layer 12 by any suitable coating technique, followed by drying the charge generating layer 13.

In some aspects of the disclosure, suitable techniques for applying the charge generating composition may include dip coating, roll coating, spray coating, rotary atomizers, and the like. Drying of the deposited coating may be effected by any suitable technique, such as oven drying, infra-red radiation drying, air drying and the like.

Charge generating layer 13 may have any suitable thickness. In some aspects of the disclosure, exemplary thicknesses may range from about 0.01 μm to about 10 μm.

As illustrated in FIG. 1, a charge transport layer 14 is formed over charge generating layer 13. Charge transport layer 14 is capable of supporting the injection of photogenerated holes from the charge generating layer 13 and allowing the transport of these holes through charge transport layer 14 in order to discharge the surface charge on electrophotographic imaging member 1. Any suitable charge transport layer may be employed, including charge transport layers that are known in the art.

In some aspects of the disclosure, charge transport layer 14 can be formed by applying a coating solution comprising a charge transport compound and a binder resin. The charge transport layer may also include optional additives used for their known conventional functions as recognized by practitioners in the art. Examples of such optional additives include antioxidants, leveling agents, surfactants, wear resistant additives, such as, polytetrafluoroethylene (PTFE) particles, shock resisting or reducing agents, and the like.

Charge transport layer 14 may comprise any suitable charge transport compound. Examples of suitable charge transport compounds include low molecular weight charge transport compounds such as pyrene, carbazole, hydrazone, oxazole, oxadiazole, pyrazoline, arylamine, arylmethane, benzidine, thiazole, stilbene and butadiene compounds; high molecular weight charge transport compounds such as poly-N-vinylcarbazole, poly-N-vinylcarbazole halide, polyvinyl pyrene, polyvinylanthracene, polyvinylacridine, pyrene-formaldehyde resin, ethylcarbazole-formaldehyde resin, triphenylmethane polymer and polysilane.

In some aspects of the disclosure, the charge transport compounds may be an aromatic amine compound of one or more compounds having the general formula:

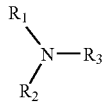

wherein $R_1$ and $R_2$ are aromatic groups selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. In some aspects of the disclosure, the substituents should be free form electron withdrawing groups such as $NO_2$ groups, CN groups, and the like.

Examples of charge transport aromatic amines represented by the structural formulae above include triphenylmethane, bis(4-diethylamine-2-methylphenyl)phenylmethane; 4'-4"-bis(diethylamino)-2',2"-dimethyltriphenylmethane; N,N'-bis(alkylphenyl)-1,1'-biphenyl-4,4'-diamine, wherein the alkyl is, for example, methyl, ethyl, propyl, and n-butyl; N,N'-diphenyl-N,N'-bis(chlorophenyl)-1,1'-biphenyl-4,4'-diamine; N,N'-diphenyl-N,N'-bis(3"-methylphenyl)-(1,1'-biphenyl)-4,4'-diamine and the like dispersed in an inactive resin binder.

The one or more binder resins of charge transport layer 14 may be any suitable binder resin, such as, for example, binder resins known in the art for use in charge transport layers. Examples of suitable binder resins include polycarbonate resin, polyvinylcarbazole resin, polyester resin, polyarylate resin, polyacrylate resin, polyether resin, polysulfone resin, and the like. Molecular weights may range from about 20,000 to about 150,000.

In some aspects of the disclosure, the binder resins are polycarbonate resins have a molecular weight from about 20,000 to about 150,000, such as from about 50,000 to about 120,000. Examples of suitable polycarbonate resins include poly(4,4'-dipropylidene-diphenylene carbonate) with a molecular weight of from about 35,000 to about 40,000, available as Lexan 145 from General Electric Company; poly (4,4'-isopropylidenediphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G.; a polycarbonate resin having a molecular weight of about 20,000 to about 100,000, available as poly (4,4'-dihydroxy-diphenyl-1-1-cyclohexane [PCZ-400] from Mitsubishi Gas Chemical Company, Ltd., and a polycarbonate resin having a molecular weight of from about 20,000 to about 50,000 available as Merlon from Mobay Chemical Company.

The one or more binder resins may be chosen so as to be soluble in a suitable solvent that can adequately dissolve the components of the composition and that has a suitably low boiling point. Examples of such solvents include methylene chloride, methanol, ethanol, n-propanol, n-butanol, benzyl alcohol, methyl cellosolve, ethyl cellosolve, acetone, methyl ethyl ketone, methyl isobutyl ketone, cyclohexanone, chlorobenzene, toluene, xylene, methyl acetate, n-butyl acetate, dioxane, tetrahydrofuran (THF), methylene chloride and chloroform, and the like, and mixtures of two or more of thereof.

Charge transport layer 14 may be formed by mixing the charge transport compounds in the binder resin, and applying the resulting composition to a substrate in the form of a layer. For example, charge transport layer 14 may be applied by spraying, dip coating, roll coating, wire wound rod coating, and the like, as is well known in the art. Drying of the deposited coating may be effected by any suitable technique. For example, drying may be accomplished by drying methods well known in the art, such as oven drying, infra-red radiation drying, and air drying.

The charge transport compounds, when mixed with the electrically inactive binder resin, form an electrically active composition capable of supporting the injection of photogenerated holes from charge generating layer 13 and allowing the transport of the holes through charge transport layer 14 in order to discharge the surface charge on the electrophotographic imaging member 1.

Charge transport layer 14 may comprise any suitable concentrations of charge transport compounds and binder resin. In one aspect, where the charge transport compound is an aromatic amine as described in relation to the aromatic amine formula above, the charge transport layer 14 may comprise from about 25 percent to about 75 percent by weight of the aromatic amine compound, and about 75 percent to about 25 percent by weight of a polymeric film forming resin in which the aromatic amine is soluble.

The thickness of the charge transport layer may be any suitable thickness. For example, the thickness may range from about 10 μm to about 50 μm, but thicknesses outside this range can also be used. In some aspects, the ratio of the thickness of the charge transport layer to the charge generating layer may range from about 2:1 to about 200:1, and in some instances as great as about 400:1.

In some aspects, charge transport layer 14 may comprise optional additives such as a plasticizer, a surface modifier, an antioxidant or an agent for preventing deterioration by light.

The charge generating layers and charge transport layers described above may be positioned over the substrate in any suitable configuration which allows formation of an electrostatic charge pattern on the electrophotographic imaging member. In the aspect of the disclosure shown in FIG. 1, the charge generating layer is formed over the support 11, and then the charge transport layer is formed over the charge generating layer. In other aspects of the disclosure, the electrophotographic imaging member may comprise an inverted configuration where the charge transport layer is formed over the support, and then the charge generating layer is formed over the charge transport layer, as is well known in the art. In yet other aspects of the disclosure, the electrophotographic imaging member may comprise multiple charge generating layers and charge transport layers. For example, U.S. Pat. No. 5,552,253, describes devices comprising multiple charge generating layers and charge transport layers formed in stacks, the description of which multiple layer devices is herein incorporated by reference in its entirety. Other suitable electrophotographic imaging member configurations may also be employed.

Overcoat layer 15 may comprise any suitable overcoat layer, including overcoat layers well known in the art. Overcoat layer 15 is formed to improve the resistance to abrasion and otherwise protect the electrophotographic image member 1. In some aspects, the thickness of the overcoat layer is from about 0.1 to about 10 μm, from about 0.5 to about 7 μm, and from about 1.5 to about 3.5 μm. Descriptions of known overcoat layers may be found, for example, in U.S. Pat. Nos. 6,911,282, 6,207,334 and 6,197,464, the descriptions of which overcoat layers are hereby incorporated by reference in their entirety.

In some aspects, one or more anti-curl back layers (not shown) may be applied to the backside of substrate 11 to provide flatness and/or abrasion resistance where a web configuration photoreceptor is fabricated. The purpose of the anti-curl backing layers is to substantially balance the total forces of the layers on the opposite side of the substrate 11, in order to reduce or prevent undesirable curling of support 11. Any suitable anti-curl backing layer may be employed in the aspects of the present disclosure. Suitable backing layers are well known in the art, such as, for example, the anti-curl backing layers described in U.S. Pat. No. 4,654,284, the description of which anti-curl, backing layers is incorporated herein by reference in its entirety.

The charge generating layers of the present disclosure may be used to form electrophotographic imaging members for any apparatus which uses the electrophotographic process to produce copies. Examples of such electrophotographic apparatus include electrophotographic copiers and printers. Such electrophotographic apparatus are well known in the art, and one of ordinary skill in the art would readily be able to apply the principles taught regarding the charge generation compositions and layers of the present disclosure to these electrophotographic apparatus.

Examples are set forth herein below and are illustrative of aspects of the present invention. It Will be apparent, however, that the principals taught in the present disclosure can be practiced with many types of compositions and can have many different uses in accordance with the disclosure above and as pointed out hereinafter.

EXAMPLE 1

A dispersion for forming a charge generating composition was prepared by combining the hydroxy gallium phthalyocyanine type V (HOGaPc V) and SAA-103™ (copolymer of 80 mole % styrene and 20 mole % allyl alcohol, having a weight average molecular weight of about 8,400), available from LYONDELL, at a weight ratio of 60:40 in tetrahydrofuran (THF). Sufficient THF was added to form a dispersion having 10% by weight solids. The dispersion was prepared with Attritor milling using 1 mm glass beads. After 3 hours of milling, the dispersion was filtered through a 20-μm-cloth filter.

COMPARATIVE EXAMPLE 1

A control dispersion was prepared using the same ingredients and procedures as in Example 1 above, except that VMCH (a terpolymer of vinyl chloride, vinyl acetate and maleic acid, available from Dow Chemical) was substituted for SM-103. The resulting dispersion comprised HOGaPc V and VMCH at a weight ratio of 60:40 in THF (10% by weight solids).

RSI measurements of the dispersion of Example 1 showed the composition to have an RSI of about 12. This was comparable to the RSI for the dispersion of Comparative Example 1, which was about 11.

EXAMPLE 2

The dispersion of Example 1 was diluted with THF to 5% by weight solids, and the resulting composition was used to prepare a photoreceptor. The photoreceptor was made by depositing a three-component undercoat layer which was prepared as follows: zirconium acetylacetonate tributoxide (35.5 parts), γ-aminopropyltriethoxysilane (4.8 parts) and poly(vinyl butyral) BM-S (2.5 parts) was dissolved in n-butanol (52.2 parts). The resulting solution was coated via a ring coater, and the layer was pre-heated at 59° C. for 13 minutes, humidified at 58° C. (dew point=54° C.) for 17 minutes, and dried at 135° C. for 8 minutes. The thickness of the undercoat layer was approximately 1.3 μm. A charge generating layer was then formed on top of the undercoat layer by depositing the composition of Example 1 diluted to 5% by weight solids, as described above, to a thickness of about 0.2 μm. A charge transport layer was coated on top of the charge generating layer from a dispersion prepared from the following ingredients: N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, $M_w$=40,000)] available from Mitsubishi Gas Chemical Company, Ltd. (7.13 grams), and PTFE POLYFLON™ L-2 microparticle (1 gram) available from Daikin Industries, the ingredients being dissolved/dispersed in a solvent mixture of 20 grams of tetrahydrofuran (THF) and 6.7 grams of toluene via a CAVIPRO™ 300 nanomizer (Five Star Technology, Cleveland, Ohio). The charge transport layer was dried at about 120° C. for about 40 minutes.

Both a full device and a thin charge transport layer device were prepared. The full device had a 28 μm charge transport layer, and the thin charge transport layer device had a 15 μm charge transport layer.

COMPARATIVE EXAMPLE 2

A control photoreceptor was prepared using the same ingredients and procedures as in Example 2 above, except that the charge generating layer comprising SAA-103 of Example 2 was replaced with a charge generating layer formed by depositing the composition comprising VMCH of Comparative Example 1, diluted to 5% by weight solids. Both a full device and a thin charge transport layer device were prepared. The full device had a 28 μm charge transport layer, while the thin charge transport layer device had a 15 μm charge transport layer.

The charge generating layer of Example 2 provided comparable performance to the halogenated VMCH charge generating layer of Comparative Example 2. For example, the photoreceptor devices of Example 2 and Comparative Example 2 showed similar discharge characteristics, short cycling stability, and print quality for the device of Example 2 compared to those of the comparative device.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an acid" includes two or more different acids. As used herein, the term "include" and its grammatical variants are intended to be non-limiting, such that recitation of items in a list is not to the exclusion of other like items that can be substituted or added to the listed items.

While particular aspects of the disclosure have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A charge generating composition, comprising:

a polymeric binder comprising styrene units and allyl alcohol units; and one or more photoconductive particles, wherein the polymeric binder is effectively free of halogen species, and wherein the polymeric binder comprises about 60 mole % to about 80 mole % styrene units and from about 20 mole % to about 40 mole % allyl alcohol units, wherein the one or more photoconductive particles are dispersed in the polymeric binder to form the charge generating composition, and wherein the styrene units and allyl alcohol units are substantially 100 mole % of the polymer units of the polymeric binder.

2. The charge generating composition of claim 1, wherein the polymeric binder is made from one or more polymers have a weight average molecular weight ranging from about 1,000 to about 300,000.

3. The charge generating composition of claim 1, wherein the polymeric binder comprises about 80 mole % styrene units and about 20% allyl alcohol units.

4. The charge generating composition of claim 3, wherein the polymeric binder is made from a polymer having a weight average molecular weight of about 8400.

5. The charge generating composition of claim 4, wherein the one or more photoconductive particles comprise hydroxyl gallium phthalyocyanine type V.

6. The charge generating composition of claim 5, wherein the photoconductive particles and the polymeric binder are at a weight ration of about 60:40.

7. An electrophotographic imaging member comprising:

a substrate;

at least one charge generating layer comprising one or more photoconductive particles and a polymeric binder comprising styrene units and allyl alcohol units, wherein the polymeric binder is effectively free of halogen species; and at least one charge transport layer wherein the charge generating layer and charge transport layer are positioned over the substrate in a configuration which allows formation of an electrostatic charge pattern on the electrophotographic imaging member, wherein the polymeric binder comprises about 60 mole% to about 80 mole % styrene units and from about 20 mole % to about 40 mole % allyl alcohol units, and further wherein the styrene units and allyl alcohol units are substantially 100 mole % of the polymer units of the polymeric binder.

8. The electrophotographic imaging member of claim 7, wherein the at least one charge generating layer is positioned over the substrate, and the at least one charge transport layer is positioned over the charge generating layer.

9. The electrophotographic imaging member of claim 7, wherein the at least one charge transport layer is positioned over the substrate, and the at least one charge generating layer is positioned over the charge transport layer.

10. The charge generating composition of claim 7, wherein the polymeric binder comprises about 80 mole % styrene units and about 20 mole % allyl alcohol units.

11. The electrophotographic imaging member of claim 10, wherein the polymeric binder is made from a polymer having a weight average molecular weight of about 8400.

12. The electrohotographic imaging member of claim 11, wherein the one or more photoconductive particles comprise hydroxyl gallium phthalyocyanine type V.

13. The electrophotographic imaging member of claim 12, wherein the photoconductive particles and the polymeric binder are at a weight ratio of about 60:40.

14. A method for making a charge generating composition, comprising:

mixing one or more photoconductive particles, one or more polymers and a solvent to form a dispersion, wherein the one or more polymers are chosen from at least one of (i) a copolymer of styrene units and allyl alcohol units, or (ii) a polymer comprising styrene units, allyl alcohol units and at least one additional unit chosen from an ethylene unit, propylene unit, isobutylene unit, 4-hydroxyl styrene unit, vinyl alcohol unit, vinyl butyral unit, acrylic unit, vinyl ether unit, vinyl pyridine unit, hydroxyalkyl acrylate unit, acrylic acid unit, methacrylic acid unit, crotonic acid unit, maleic acid unit, vinyl benzoic acid unit, and vinyl phosphonic acid unit, and wherein the one or more polymers do not comprise a halogen;

applying the dispersion to a substrate; and drying the dispersion to form a charge generating composition comprising the one or more photoconductive particles dispersed in a polymeric binder, wherein the polymeric binder comprises about 60 mole % to about 80 mole % styrene units and from about 20 mole % to about 40 mole % allyl alcohol units, and further wherein the styrene units and allyl alcohol units are substantially 100 mole % of the polymer units of the polymeric binder.

15. The method of claim 14, wherein the mixing is accomplished by milling the photoconductive particles and one or more polymers in the presence of at least a portion of the solvent.

16. The method of claim 14, wherein the mixing is accomplished by milling the photoconductive particles and one or more polymers in the absence of the solvent, and then subsequently adding the solvent to the mixture.

17. The charge generating composition of claim 14, wherein the polymeric binder comprises about 80 mole % styrene units and about 20% allyl alcohol units.

18. The method of claim 17, wherein the polymeric binder is made from a polymer having a weight average molecular weight of about 8400.

19. The method of claim 18, wherein the one or more photoconductive particles comprise hydroxyl gallium phthalyocyanine type V.

20. The method of claim 19, wherein the photoconductive particles and the polymeric binder are at a weight ratio of about 60:40.

* * * * *